US012655648B2

(12) United States Patent
Kehati

(10) Patent No.: US 12,655,648 B2
(45) Date of Patent: Jun. 16, 2026

(54) POOL RELATED PLATFORM (PRP)

(71) Applicant: Maytronics Ltd., Kibutz Yizrael (IL)

(72) Inventor: Avshalom Kehati, Zikhron Yaakov (IL)

(73) Assignee: Maytronics Ltd., Kibutz Yizrael (IL)

( * ) Notice: Subject to any disclaimer, the term of this patent is extended or adjusted under 35 U.S.C. 154(b) by 77 days.

(21) Appl. No.: 18/611,604

(22) Filed: Mar. 20, 2024

(65) Prior Publication Data

US 2024/0318450 A1 Sep. 26, 2024

(30) Foreign Application Priority Data

Mar. 20, 2023 (IL) ..... 301519

(51) Int. Cl.
*E04H 4/14* (2006.01)

(52) U.S. Cl.
CPC ..... *E04H 4/14* (2013.01)

(58) Field of Classification Search
CPC ..... E04H 4/1654
See application file for complete search history.

(56) References Cited

U.S. PATENT DOCUMENTS

| | | | | |
|---|---|---|---|---|
| 11,004,324 | B1 * | 5/2021 | Sánchez Henares | G01S 7/003 |
| 11,345,611 | B2 * | 5/2022 | Burnham | E04H 4/148 |
| 2014/0263087 | A1 * | 9/2014 | Renaud | E04H 4/1654 210/745 |
| 2017/0043966 | A1 | 2/2017 | Witelson et al. | |
| 2021/0032888 | A1 | 2/2021 | Lancry et al. | |
| 2023/0105447 | A1 * | 4/2023 | Duffaut | G08B 7/06 4/508 |

* cited by examiner

*Primary Examiner* — Christine J Skubinna
(74) *Attorney, Agent, or Firm* — RECHES PATENTS

(57) ABSTRACT

A detachable pool related platform that includes a housing, a sensing unit that comprises a location unit that is configured to locate a submerged robot that is submerged in a pool, a communication unit that is configured to communicate with the submerged robot, and a detachable interface that is configured to detachably mount the detachable system onto a surface of the pool.

20 Claims, 14 Drawing Sheets

15

16

19

POOL RELATED PLATFORM (PRP)

BACKGROUND

There may be a growing need to enhance the capabilities of a pool and/or submerged robots that are located in a pool—in an efficient manner.

SUMMARY

There may be provided a PRP.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
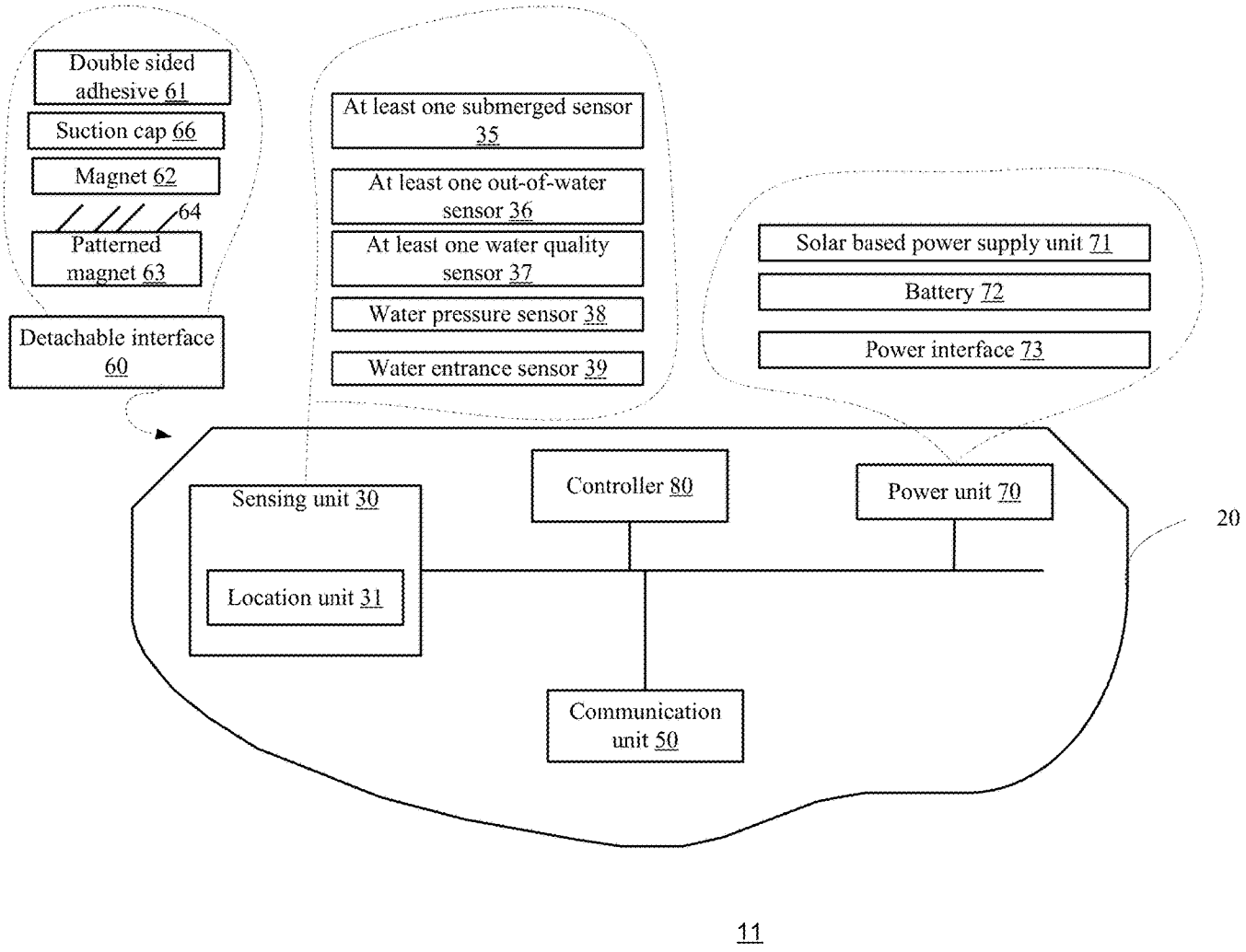
FIG. 1 illustrates an example of a PRP.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF THE PREFERRED EMBODIMENTS

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the Summary of the invention of the specification.

The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

The term "and/or" is additionally or alternatively.

The terms "control unit", "remote control device", "control device" and "mobile computer" are used in an interchangeable manner.

Any reference in the specification to a pool cleaning robot should be applied mutatis mutandis to a method that can be executed by the pool cleaning robot and to a computer readable medium that stores instructions to be executed by the pool cleaning robot.

Any reference in the specification to a mobile computer should be applied mutatis mutandis to a method that can be executed by the mobile computer and to a computer readable medium that stores instructions to be executed by the mobile computer.

Any reference in the specification to method should be applied mutatis mutandis to a pool cleaning robot and/or to a mobile computer that execute the method and/or to a computer readable medium that stores instructions that once executed result in an execution of the method.

Any reference in the specification to a non-transitory computer readable medium should be applied mutatis mutandis to a pool cleaning robot and/or a mobile computer capable of executing the instructions stored in the non-transitory computer readable medium and should be applied mutatis mutandis to method that may be executed by a pool cleaning robot and/or a mobile computer that reads the instructions stored in the non-transitory computer readable medium.

Because the illustrated embodiments of the present invention may for the most part, be implemented using electronic components, touch screens and circuits known to those skilled in the art, details will not be explained in any greater extent than that considered necessary as illustrated above, for the understanding and appreciation of the underlying concepts of the present invention and in order not to obfuscate or distract from the teachings of the present invention.

Any reference in the specification to a method should be applied mutatis mutandis to a system capable of executing the method and should be applied mutatis mutandis to a non-transitory computer readable medium that stores instructions that once executed by a computer result in the execution of the method.

A PRP is any platform that may perform an operation related to or in pool water. Examples of a PRP include a pool robot that differs from a pool cleaning robot (PCR), a PCR, a floating unit, a skimmer, and the like. Any example related a PCR may be applied mutatis mutandis, to any other PRP.

There may be provided a detachable pool related platform (PRP) that is compact and can be easily detached to a sidewall of a pool.

FIG. 1 illustrates an example of PRP 11 that includes:

a. A housing 20.

b. A sensing unit 30 that includes a location unit 31 that is configured to locate a submerged robot that is submerged in a pool.

c. A communication unit 50 that is configured to communicate with the submerged robot.

d. A detachable interface 60 that is configured to detachably mount the detachable system onto a surface of the pool.

e. A power unit 70. The power unit may include at least one of a solar based power supply unit 71 that may include photovoltaic cells, a battery 72, a power interface 73 (for example a socket) for receiving power from an external power source.

f. A controller 80 for controlling the operation of the PRP.

The location unit 31 may include one or more location unit sensors 32 such as one or more visual sensors 31-1 and/or one or more non-visual sensors 31-2 (for example radars, sonars, and other radiation sensors).

The detachable interface 60 may include at least one of:

a. A double sided adhesive 61.

b. A magnet 62.

c. A patterned magnet 63 that includes a patterned interface 64—for example may include one or more protrusions and/or one or more recesses—that may fit corresponding elements in a sidewall of a pool—for providing magnetic and mechanical attachment.

d. A suction cap 66 e. Mechanical interface.

The sensing unit 30 may include at least one of:

a. At least one submerged sensor 35.

b. At least one out-of-water sensor 36 located outside the water of the pool.

c. A water quality sensor 37 that may be regarded as an example of a submerged sensor.

d. A water pressure sensor 38.

e. User entrance sensor 39 that is configured to sense an entrance of a user into the pool.

The PRP is compact in the sense that its length may not exceed 50 cm and/or may not have a width that exceeds 40 cm and/or may not have a depth that exceeds 20 cm and the like.

The length of the PRP may range between 10-50 cm—especially between 15 and 35 cm.

The width of the PRP may range between 8-20 cm.

The depth of the PRP may range between 5-15 cm.

The PRP may be lightweight—(for example—have a weight that does not exceed, 0.5, 1, 1.5, 2, 2.5, 3, 3.5, 4 kg and the like)—which may simplify the attachment of the PRP to a sidewall of the pool, and may guarantee that the PRP will be firmly attached to the sidewall of the pool while using relatively compact and/or not requiring heavy duty attachment elements.

The PRP may have a shape that differs from the shape illustrated in various figures.

Figure 2:
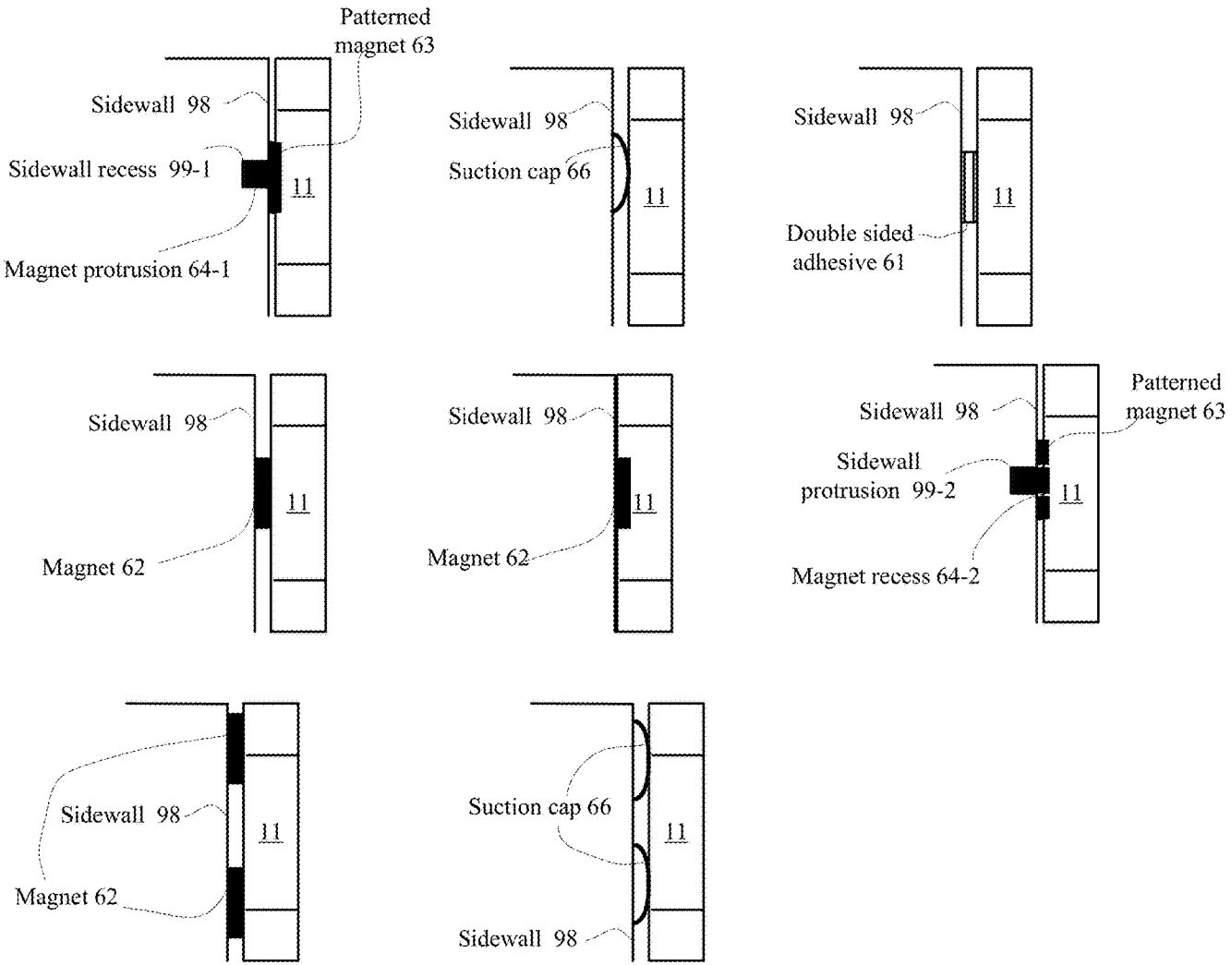
FIG. 2 illustrates example of detachably connecting the PRP to a sidewall of a pool.

FIG. 2 illustrates various examples of an attachment of the PRP 11 to a sidewall of a pool. The examples include attachment using a double side adhesive 61, attachments using one or two magnets 62, attachments using one or two suction caps 66, attachments using patterned magnet 63—one patterned magnet with a protrusion 64-1 that fits a recess in sidewall 98, and another with a recess 64-2 that fits a protrusion of sidewall 98.

The number of detachable interfaces may exceed one. A PRP may be attached by a combination of different types of detachable interfaces—for example magnet and a double side adhesive, and the like.

The patterned interface may include a patterned elements (recess and/or protrusion) that may be arranged in a one or two dimensional array.

The protrusions and/or the recesses may be of any shape and/or size—for example cylindrical, conical, box-shaped and the like.

Figure 3:
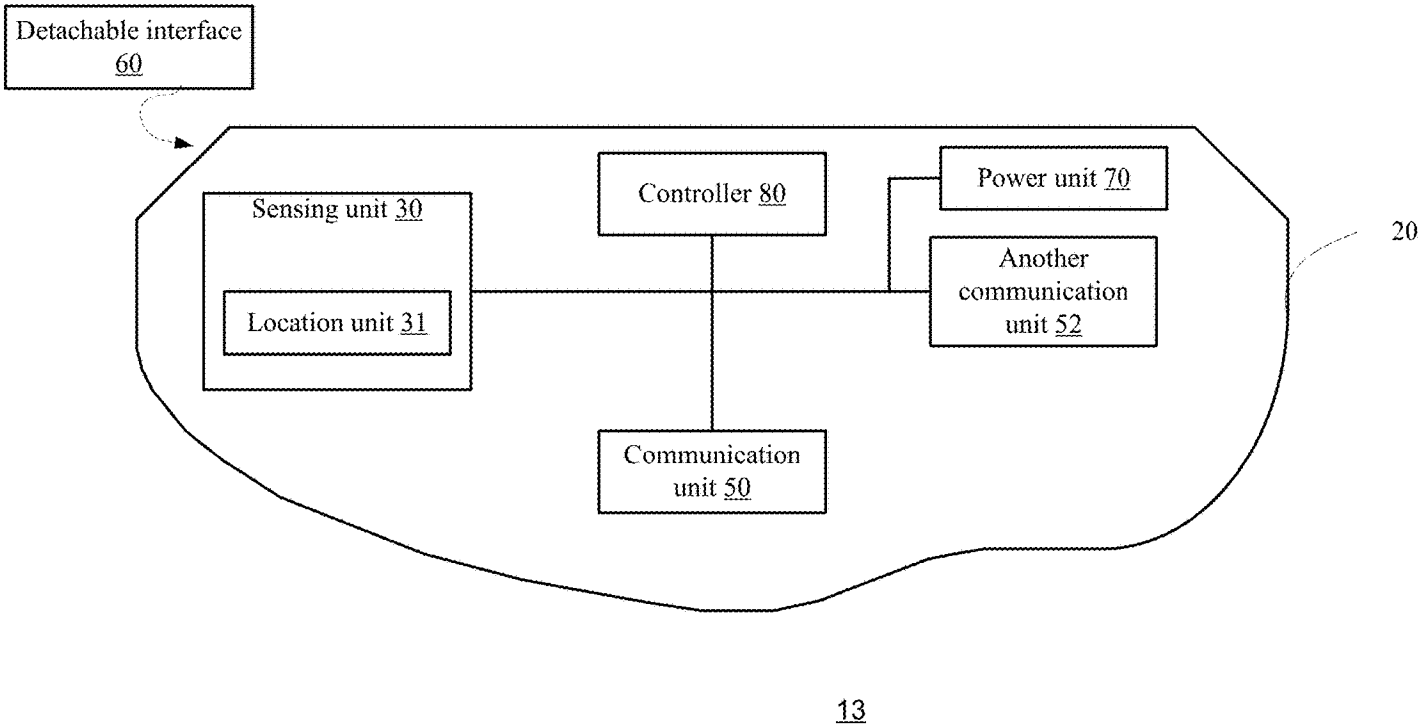
FIG. 3 illustrates an example of a PRP.

FIG. 3 illustrates an example of PRP 13 that differs from PRP 11 by including another communication unit 53 that is configured to communicate with one or more external objects that are located outside the pool.

Figure 4:
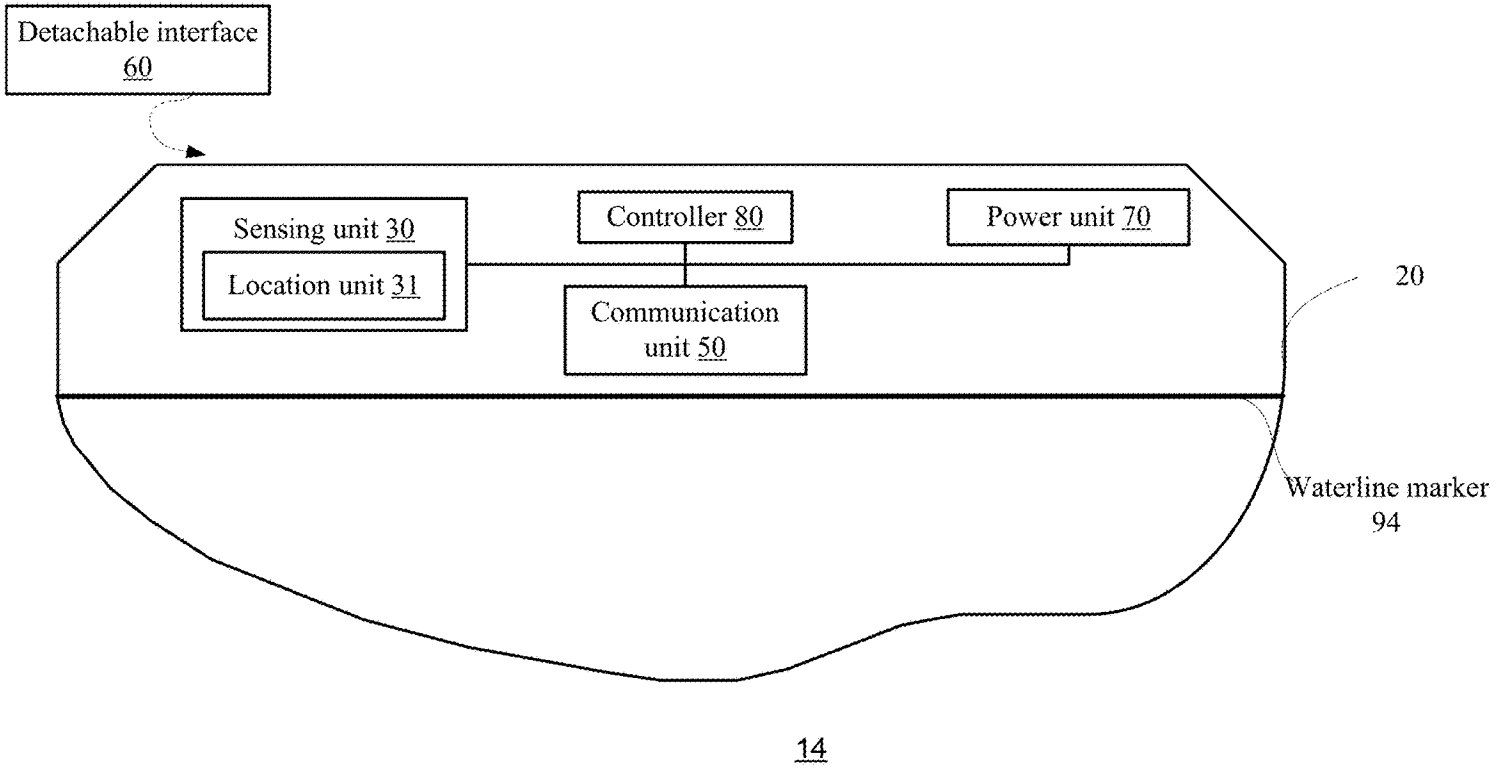
FIG. 4 illustrates an example of a PRP.

FIG. 4 illustrates an example of PRP 14 that differs from PRP 11 by including a waterline marker 94 that assists in positioning the PRP at the right location. It may prevent placing the PRP at a location that is too high that may not expose a sensor that should be submerged to the water of the pool. It may prevent placing the PRP at a location that is too low that an out-of-water sensor is positioned under the water.

Figure 5:
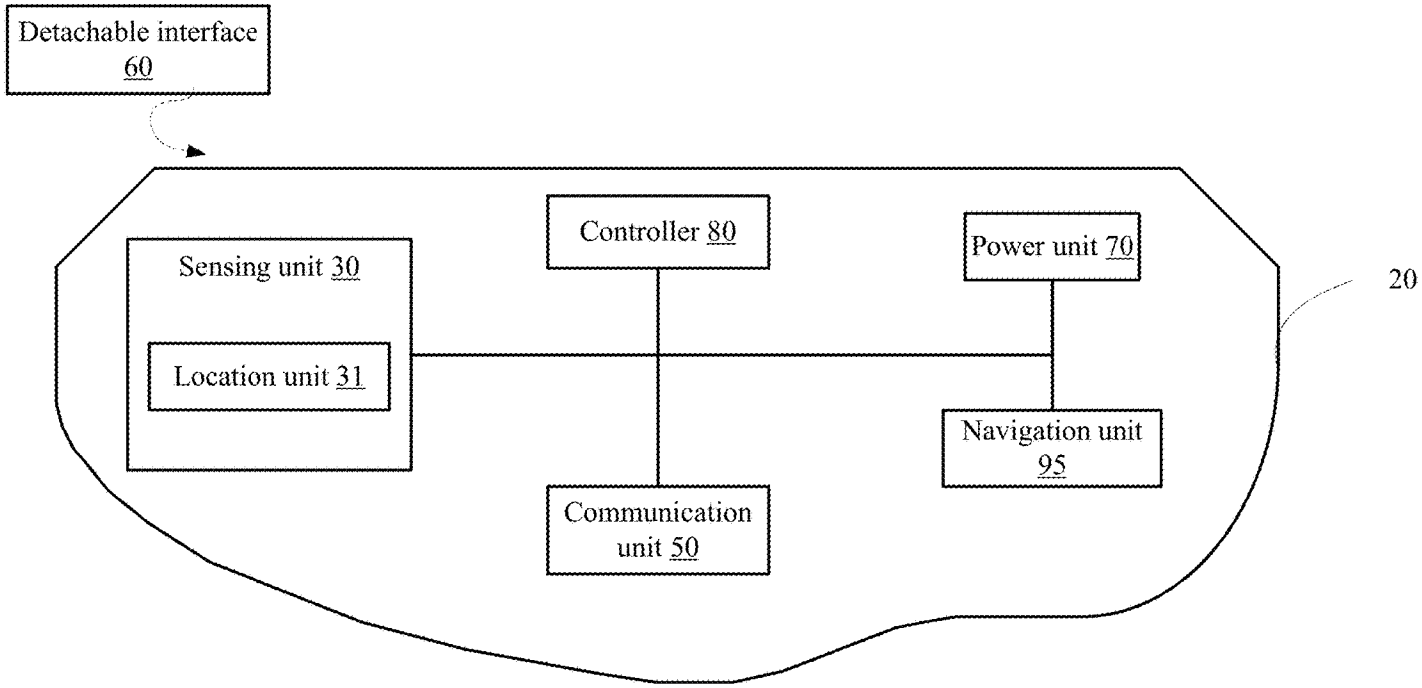
FIG. 5 illustrates an example of a PRP.

FIG. 5 illustrates an example of PRP 15 that differs from PRP 11 by including a navigation unit 95 that is configured to generate navigation information based on the location of the submerged robot, the environment of the submerged robot (for example underwater obstacles) and information regarding a desired path that the submerged robot should follow or a desired target of the submerged robot. The communication unit 50 is configured to transmit the navigation information to the submerged robot.

Figure 6:
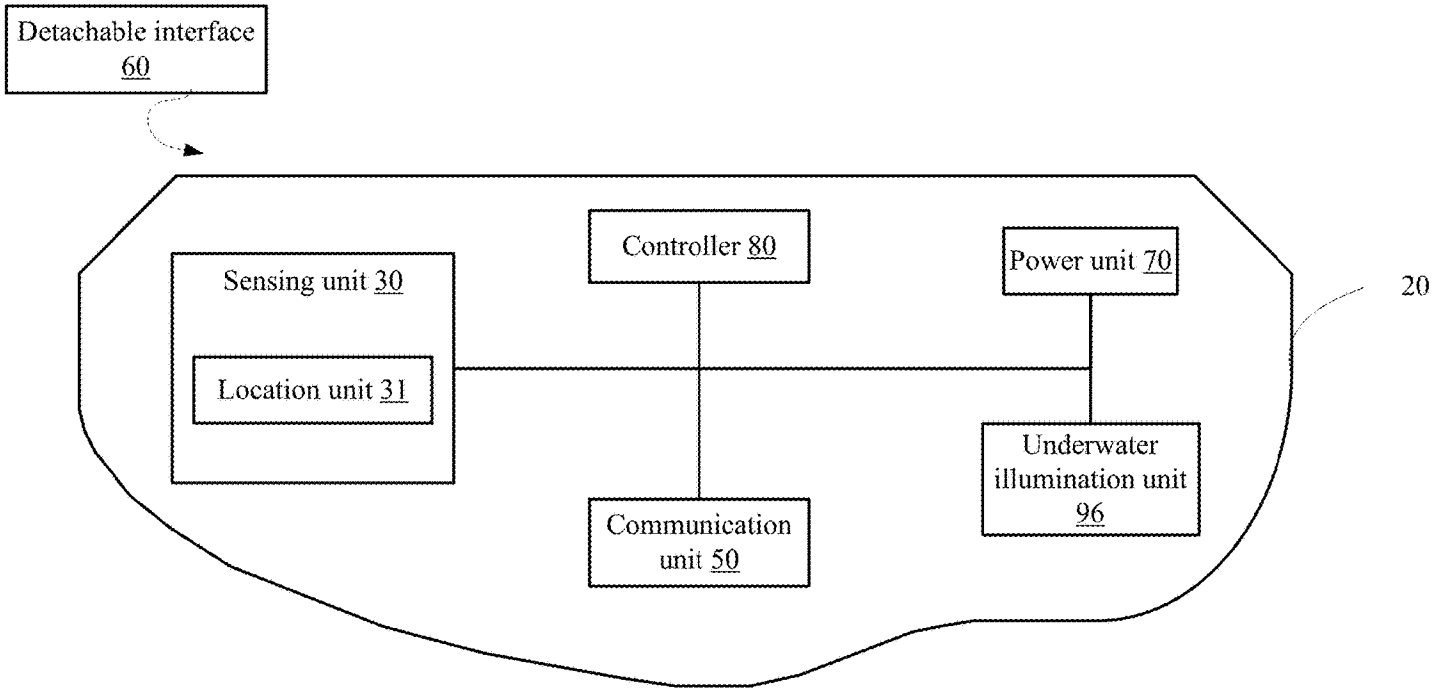
FIG. 6 illustrates an example of a PRP.

FIG. 6 illustrates an example of PRP 16 that differs from PRP 11 by including underwater illumination unit 96.

Figure 7:
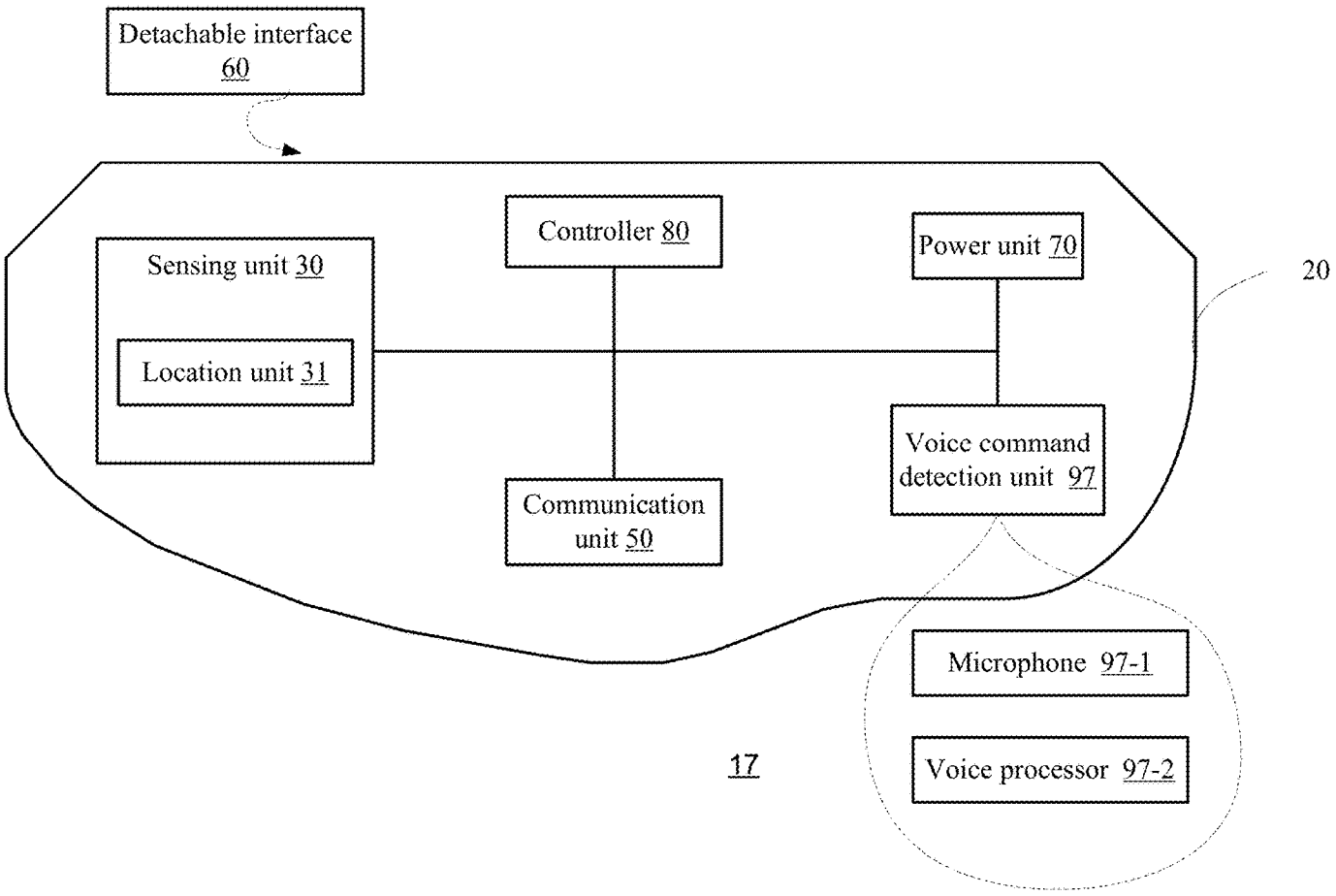
FIG. 7 illustrates an example of a PRP.

FIG. 7 illustrates an example of PRP 17 that differs from PRP 11 by including voice command detection unit 97 that includes a microphone 97-1, and a voice processor 97-2 for detecting the voice command. Signals indicative of the detected voice command are sent to controller 80.

Figure 8:
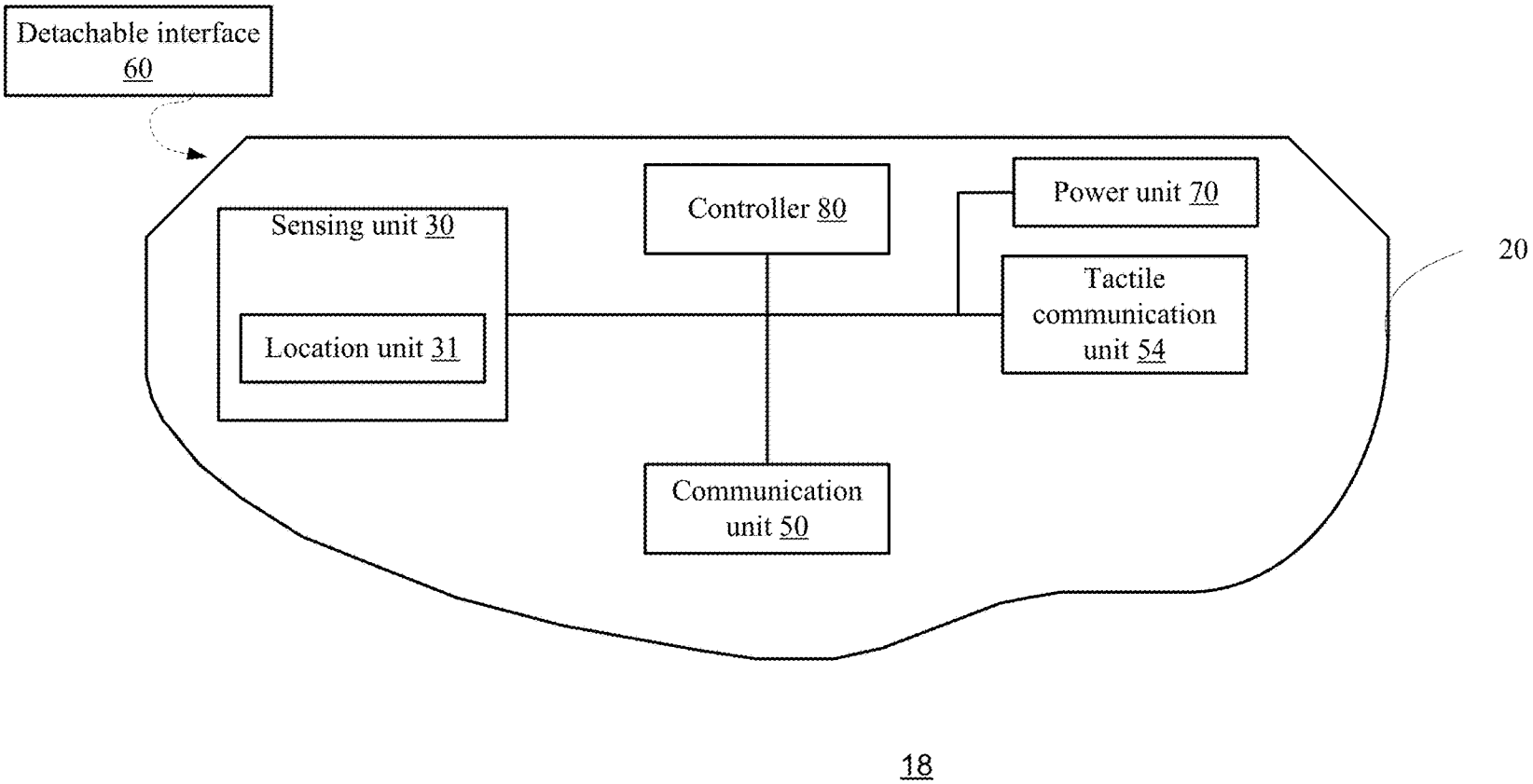
FIG. 8 illustrates an example of a PRP.

FIG. 8 illustrates an example of PRP 18 that differs from PRP 11 by including tactile communication unit 54 that is configured to detect taps or other touches of the PRP by a human operator and convert them to commands or requests that are sent to the controller 80.

Figure 9:
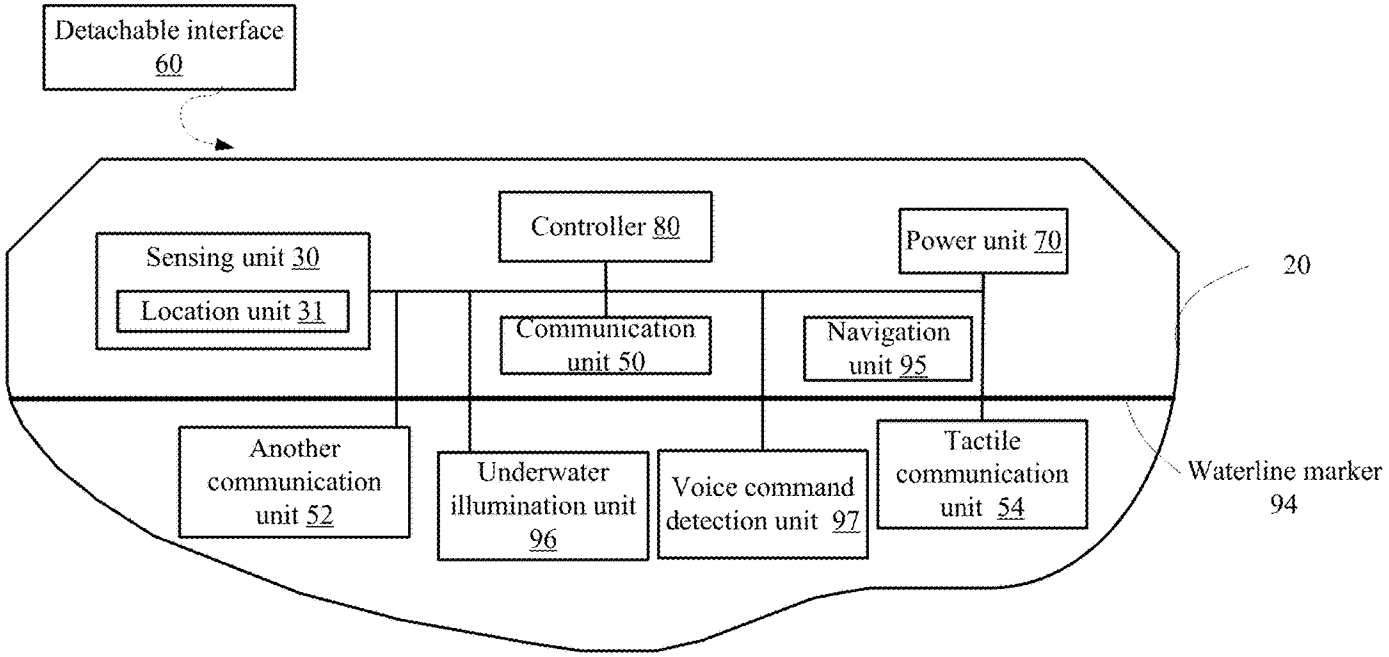
FIG. 9 illustrates an example of a PRP.

FIG. 9 illustrates an example of PRP 19 that differs from PRP 11 by including another communication unit 53, waterline marker 94, navigation unit 95, underwater illumination unit 96, voice command detection unit 97 and tactile communication unit 54.

Figure 10:
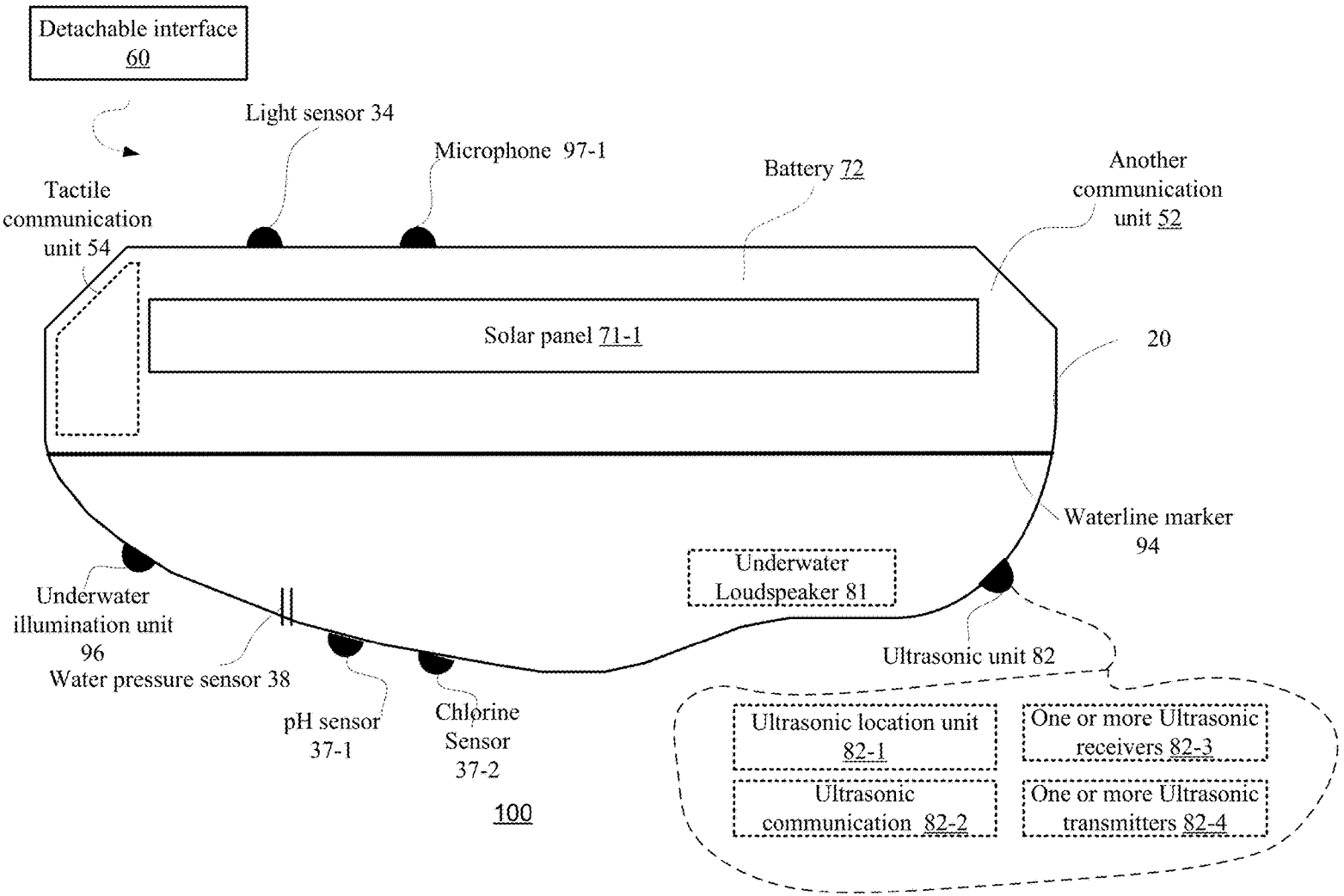
FIG. 10 illustrates an example of a PRP.

FIG. 10 illustrates an example of PRP 100 that includes:

a. Housing 20.

b. A sensing unit that includes sensors such as water pressure sensor 38, water quality sensors such as pH sensor 37-1 and Chlorine sensor 37-2, light sensor 34 that may face upwards for night or day sensing.

c. An ultrasonic unit 82 that may include at least one of an ultrasonic communication unit 82-2 for underwater communication, an ultrasonic location unit 82-1 for locating a submerged robot, one or more ultrasonic receivers 82-3, one or more ultrasonic transmitters 82-4. The ultrasonic unit may include a processing circuit for processing echoes received by a ultrasonic receiver.

d. Another communication unit 52.

e. Underline marker 94.

f. Underwater loudspeaker 81 for providing underwater music or any other audio content.

g. Detachable interface 60.

h. A power unit 70 that includes a solar panel 71-1 and a battery 72.

i. Underwater illumination unit 96 that may include one or more light emitting diodes for emitting any light pattern and/or any light color.

j. Tactile communication unit 54.

The PRP may be modular in the sense that is may include one or more modular parts such as one or more detachable units or one or more replaceable units. The modular parts may be attached to the PRP in various manners and the PRP may include one or more interfaces that are connected to (in a detachable or non detachable manner) to one or more modular parts.

Figure 11:
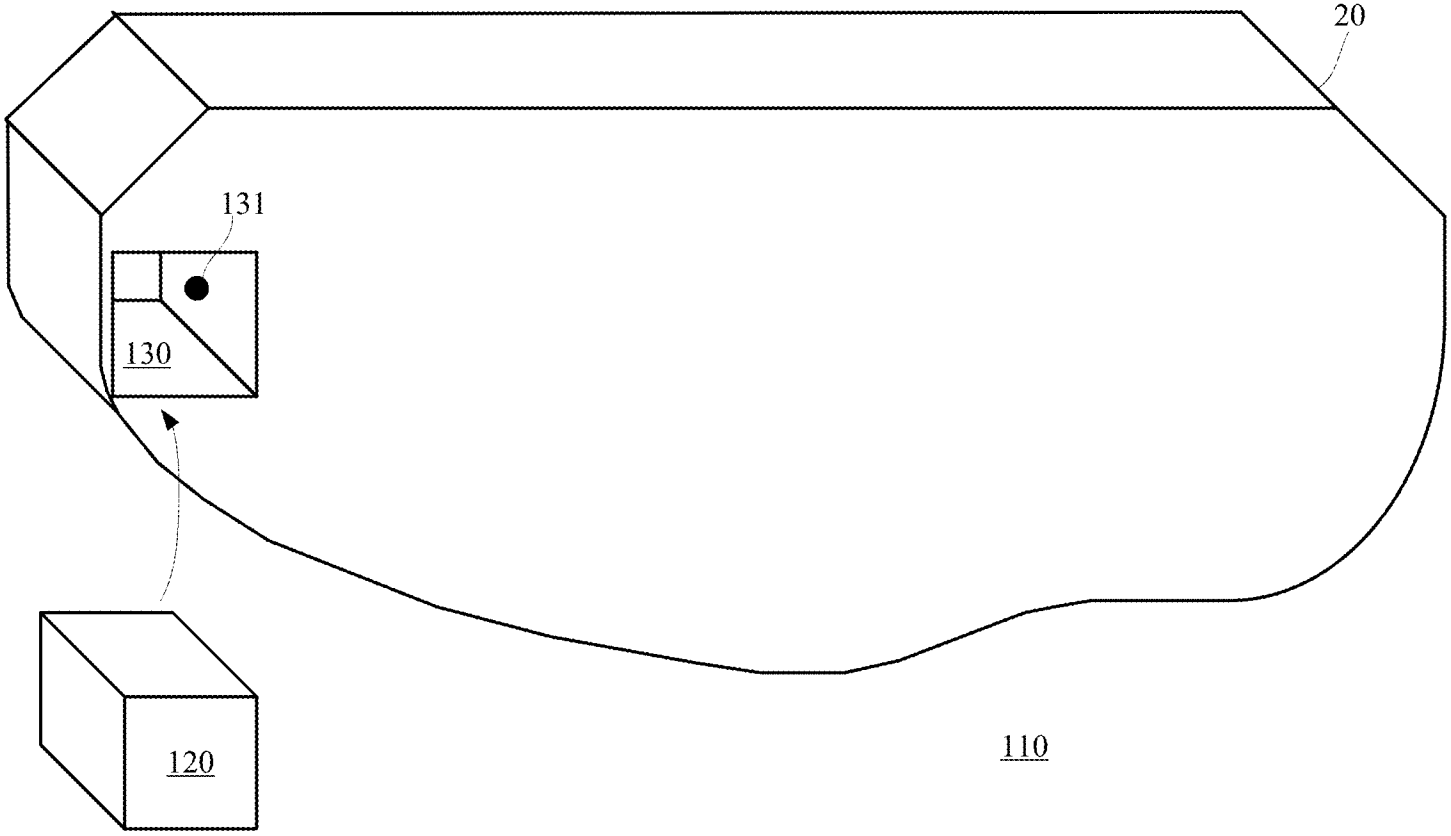
FIG. 11 illustrates an example of a PRP.

FIG. 11 illustrates an example of a PRP 110 that includes an interface 130 having a power or communication port or socket, whereas the interface is exposed to the exterior of the PRP. FIG. 11 also illustrates a modular part 120 that fits to the interface 130. The modular part may be by any unit or any part of any unit illustrated in any one of FIGS. 1-10 and/or any other unit such as a dispenser for releasing chemicals. Interface 130 may interface with multiple modular parts. There may be more than one interfaces—located in any location.

Figure 12:
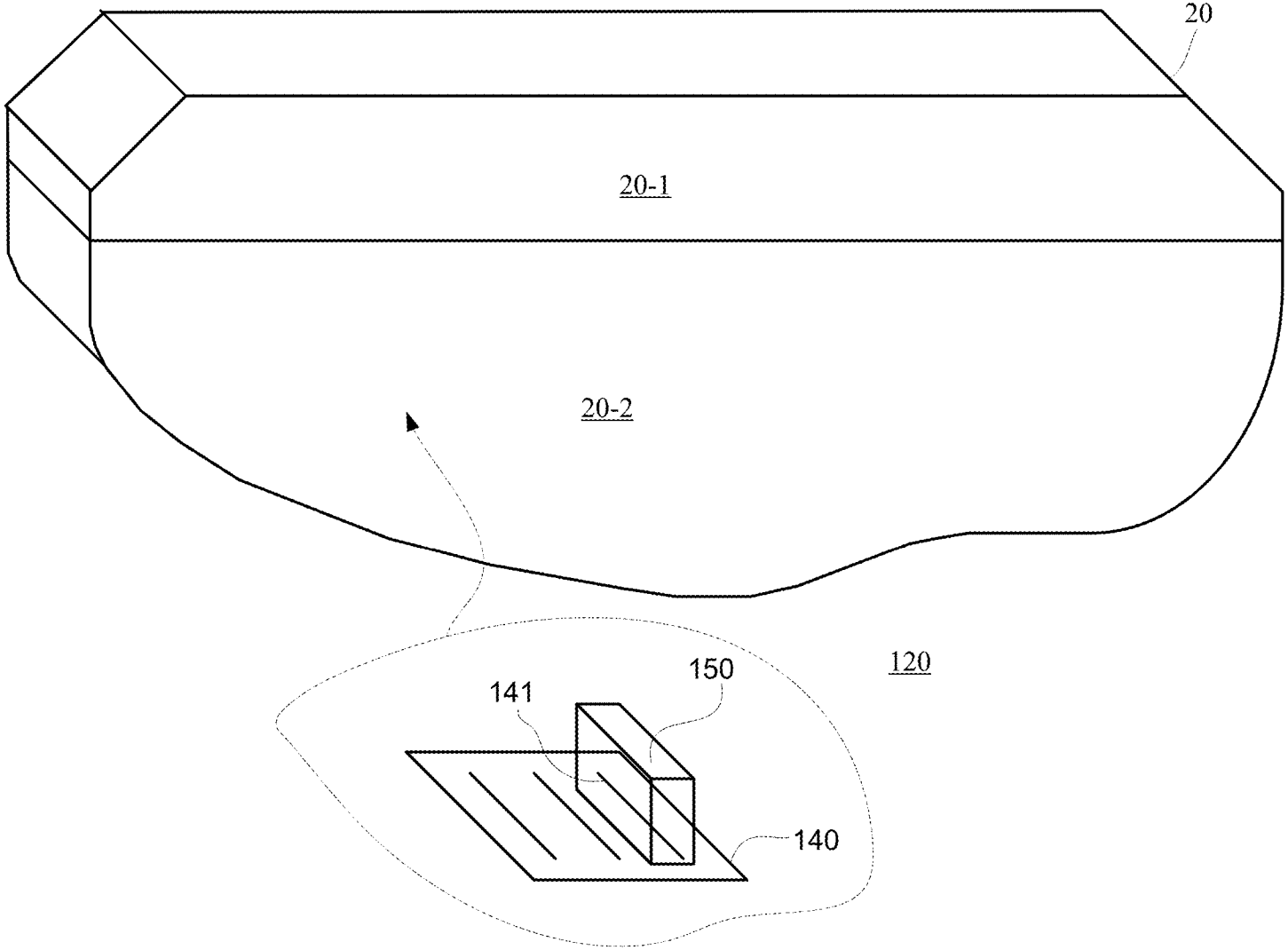
FIG. 12 illustrates an example of a PRP.

FIG. 12 illustrates an example of a PRP 120 that includes an internal interface 140 having multiple interfacing elements (a first one is denoted 141) that may provide mechanical support and/or may include power and/or communication port or socket. The interface is internal and is not exposed to the exterior of the PRP. In FIG. 12 the housing 20 has two parts 20-1 and 20-2 that may be separated from each other and expose the internal interface. FIG. 12 also illustrates a modular part 150 that fits to the first interfacing element. The modular part may be by any unit or any part of any unit illustrated in any one of FIGS. 1-10.

The internal interface may be configured to interface with one or multiple modular parts.

Any combinations or sub-combinations of units of any one of PRPs 11-19, 100, 110 and 120 may be provided.

A PRP may include multiple units and/or components (see PRP 101 of FIG. 13), a housing 20 and a detachable interface. The multiple units and/or components may be any units and/or components illustrated in any one of FIGS. 1-12. The multiple units and/or components may or may not include multiple sensor, may or may not include a location unit, and the like. The PRP may include one or more out of ultrasonic unit, underwater ultrasonic communication unit, one or more ultrasonic receivers, one or more ultrasonic transmitters, one or more communication units, waterline marker, loudspeaker, power unit, one or more sensors, illumination unit, man machine interface, controller, navigation unit, microphone, voice command detection unit, and the like.

Figure 14:
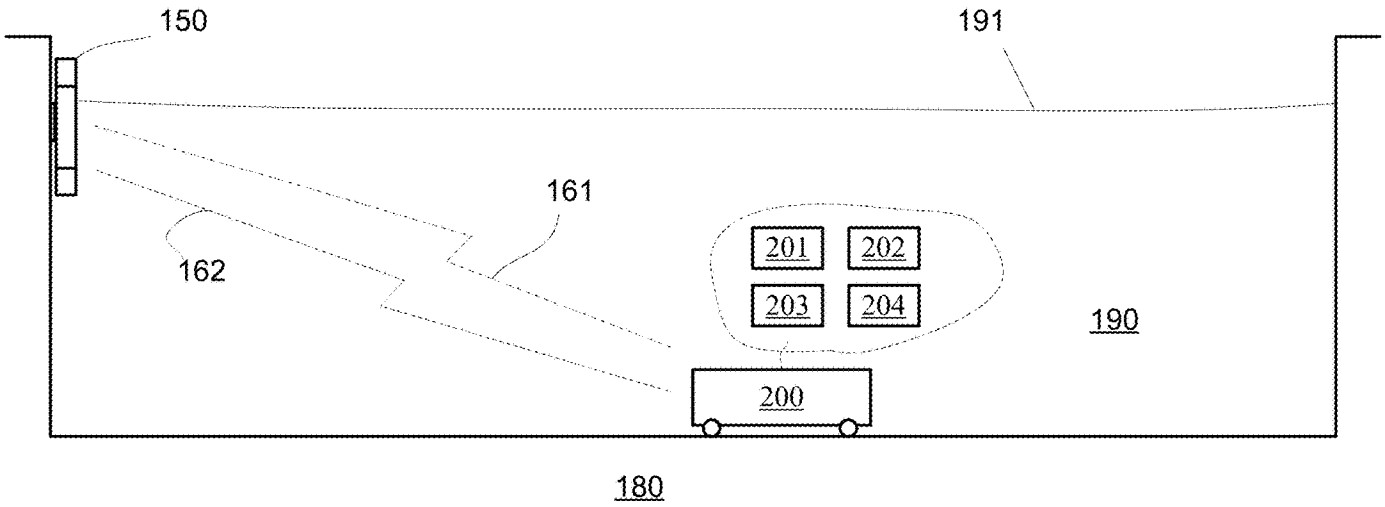
FIG. 14 illustrates an example of a PRP, a submerged robot and a pool.

FIG. 14 illustrates a PRP 150, submerged robot 200, pool 180 having a water 190 that has a waterline 191. The submerged robot 200 may include a controller 201, communication unit 202 and additional units 203 and 204 (or any number of additional units) that are configured to perform various operations such as moving the submerged robot and one or more additional operations such as cleaning the pool, monitoring the status of the pool, and the like.

Figure 13:
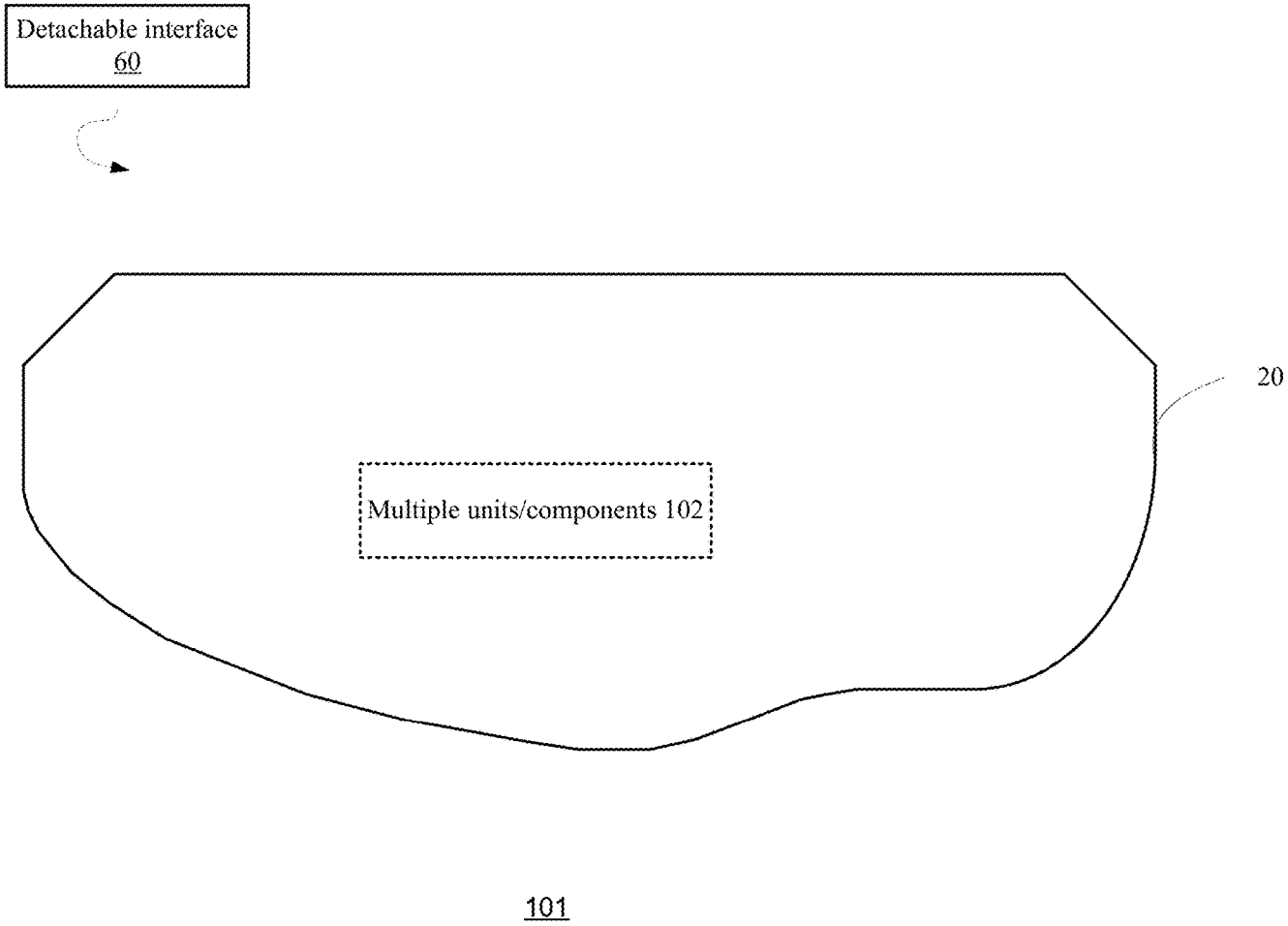
FIG. 13 illustrates an example of a PRP.

FIG. 13 also illustrates a communication link 161 between the PRP and the submerged robot, and a radiation 161 (such as acoustic radiation, ultrasound radiation used to locate the submerged robot 20.

PRP 150 may be any of the PRPs illustrated in any of the previous figures.

Any reference to any one of "including" or "comprising" or "having" may be applied mutatis mutandis to any one of "consisting" and "consisting essentially of". For example—any method may include at least the steps included in the figures and/or in the specification, only the steps included in the figures and/or the specification. The same applies to the pool cleaning robot and the mobile computer.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one as or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements the mere fact that certain measures are recited in mutually different claims does not indicate that a combination of these measures cannot be used to advantage.

Any system, apparatus or device referred to this patent application includes at least one hardware component.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

I claim:

1. A detachable pool related platform (PRP), comprising:

a housing;

a sensing unit that comprises a location unit that is configured to locate a submerged robot that is submerged in a pool;

a communication unit that is configured to communicate with the submerged robot;

a detachable interface that is configured to detachably mount the detachable system onto a sidewall of the pool;

wherein the sensing unit comprises at least one submerged sensor and at least one out of water sensor.

2. The detachable PRP according to claim 1, wherein the detachable interface comprises at least one of a magnet, a suction cup, or a double sided adhesive.

3. The detachable PRP according to claim 1, wherein the detachable interface comprises a magnet that comprises one or more protrusions.

4. The detachable PRP according to claim 1, comprising another communication unit that is configured to communicate with one or more external objects that are located outside the pool.

5. The detachable PRP according to claim 1, wherein the sensing unit comprises at least one of a water quality sensor or a water pressure sensor.

6. The detachable PRP according to claim 1, wherein the sensing unit comprises a user entrance sensor that is configured to sense an entrance of a user into the pool.

7. The detachable PRP according to claim 1, wherein the location unit comprises a combination of a visual sensor and a non-visual sensor.

8. The detachable PRP according to claim 1, comprising a solar based power supply unit.

9. The detachable PRP according to claim 1, wherein the housing comprises a waterline marker.

10. The detachable PRP according to claim 1, comprising a navigation unit that is configured to generate navigation information; wherein the communication unit is configured to transmit the navigation information to the submerged robot.

11. The detachable PRP according to claim 1, comprising an underwater illumination unit.

12. The detachable PRP according to claim 1, comprising a microphone and a voice command detection unit.

13. The detachable PRP according to claim 1, comprising a tactile communication unit.

14. A method for operating a detachable pool related platform (PRP), the method comprises:

locating, by a location unit of sensing unit of the PRP, a submerged robot that is submerged in a pool;

communicating, by a communication unit of the PRP, with the submerged robot;

wherein the location unit and the location unit are located within a housing of the PRP, the housing is detachably mounted, by detachable interface of the PRP, onto a sidewall of the pool; wherein the sensing unit comprises at least one submerged sensor and at least one out of water sensor.

15. The detachable PRP according to claim 1, further comprising at least one interface that has a power or communication port or socket, and (b) at least one modular part that fits to the at least one interface.

16. The detachable PRP according to claim 15, wherein the at least one modular part is selected of a sensing unit, an ultrasonic unit, a communication unit, an underwater loudspeaker, an underwater illumination unit and a tactile communication unit, wherein at an absence of the modular part the interface is exposed to the exterior of the detachable PRP.

17. The detachable PRP according to claim 15, wherein the at least one modular unit is a dispenser for releasing chemicals.

18. The detachable PRP according to claim 1, wherein the sensing unit comprises at least one submerged sensor and at least one out-of-water sensor.

19. The detachable PRP according to claim 1, wherein the detachable interface is configured to detachably mount the detachable system onto a sidewall of the pool while maintaining the detachable interface spaced apart from the sidewall of the pool.

20. The detachable PRP according to claim 1, further comprising at least one internal interface, each interface comprises multiple interfacing elements that provide mechanical support and comprise at least one out of power port, a power socket, a communication port or a communication socket.

* * * * *